US007304458B2

(12) United States Patent
Kakinuma

(10) Patent No.: US 7,304,458 B2
(45) Date of Patent: Dec. 4, 2007

(54) REGULATOR CIRCUIT

(75) Inventor: Takashi Kakinuma, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 11/593,649

(22) Filed: Nov. 7, 2006

(65) Prior Publication Data

US 2007/0108950 A1 May 17, 2007

(30) Foreign Application Priority Data

Nov. 7, 2005 (JP) ..... 2005-322664

(51) Int. Cl.
*G05F 1/40* (2006.01)

(52) U.S. Cl. ..... 323/280; 323/274; 323/284

(58) Field of Classification Search ..... 323/314, 323/316, 274, 280, 282, 284
See application file for complete search history.

(56) References Cited

U.S. PATENT DOCUMENTS 5,525,897 A * 6/1996 Smith ..... 323/315
7,002,329 B2 * 2/2006 Agari et al. ..... 323/284
7,193,399 B2 * 3/2007 Aikawa ..... 323/282

FOREIGN PATENT DOCUMENTS

JP 2000-284843 10/2000

* cited by examiner

*Primary Examiner*—Jessica Han
(74) *Attorney, Agent, or Firm*—Morrison & Foerster LLP

(57) ABSTRACT

A regulator circuit is offered to resolve a problem that an unnecessary operating current flows in a semiconductor integrated circuit in a low power consumption state. Channel width to channel length ratios of an output transistor in a first operational amplifier and a first control MOS transistor are designed large in order to obtain an operating current in a normal operation state, while channel width to channel length ratios of an output transistor in a second operational amplifier and a second control MOS transistor are designed small to obtain an operating current in the low power consumption state. There is provided a switching circuit that selectively put in operation one of the operational amplifiers according to the state of the integrated circuit. The first operational amplifier and the first control MOS transistor having higher current driving capabilities operate in the normal operation state. The second operational amplifier and the second control MOS transistor having lower current driving capabilities operate in the low power consumption state.

5 Claims, 4 Drawing Sheets

REGULATOR CIRCUIT

CROSS-REFERENCE OF THE INVENTION

This application claims priority from Japanese Patent Application No. 2005-322664, the content of which is incorporated herein by reference in its entirety.

BACKGROUND OF THE INVENTION

1. Field of the Invention

This invention relates to a dropper type regulator that generates a desired voltage from a higher voltage.

2. Description of the Related Art

A common semiconductor integrated circuit and a conventional regulator circuit will be explained referring to FIGS. 3 and 4.

FIG. 3 is a layout showing the common semiconductor integrated circuit. An internal circuit 101 is disposed in a middle of an LSI chip 100 such as a microcomputer. The internal circuit 101 is composed of analog circuits and digital circuits. The internal circuit 101 is surrounded with circuits (hereafter collectively referred to as I/O circuits 102) serving as input circuits that receive input signals from outside of the LSI chip 100 and transfer them to the internal circuit 101 or serving as output circuits that output signals from the internal circuit 101 to external circuits. A predetermined power supply voltage Vdd that is necessary for operation of each of the circuits is supplied externally.

Some kinds of LSI chip 100 require generating a desired low voltage (3 volts, for example) suitable for driving the internal circuit 101 from the power supply voltage (5 volts, for example) used to drive the I/O circuits 102, in order to reduce power consumption. The dropper type regulator circuit is used to generate such a low voltage.

FIG. 4 is a circuit diagram showing a conventional dropper type regulator circuit. The regulator circuit is provided with a control MOS transistor 103 of P-channel type having a source to which the power supply voltage Vdd is applied, first and second resistors 104 and 105 connected in series with the control MOS transistor 103, an operational amplifier 106 having a first differential input terminal (−) to which a reference voltage Vref is applied, a second differential input terminal (+) to which a voltage Va at a connecting node between the first resistor 104 and the second resistor 105 is applied and a differential output terminal which is connected with a gate of the control MOS transistor 103. An output voltage Vout is obtained from a connecting node between the control MOS transistor 103 and the first resistor 104. The reference voltage Vref is generated by a bandgap reference voltage generation circuit 107 known in the art, for example. Technologies of the regulator circuit are disclosed in Japanese Patent Application Publication No. 2000-284843.

Not all circuits in a microcomputer are required to operate at any instance. Other than a normal operation state, there is a low power consumption state, such as a stand-by state, which includes various modes consuming various operating currents. For example, a CPU (Central Processing Unit) stops executing instructions in a HALT mode. In addition, supply of clocks to the other circuits is stopped in an IDLE mode. Furthermore, an oscillation of the system clock itself is stopped in a STOP mode.

In the conventional regulator circuit described above, however, an output transistor constituting the operational amplifier 106 and the control MOS transistor 103 are designed considering the maximum load current so that the predetermined voltage is stably maintained in the normal operation state. As a result, there arises a problem that an unnecessary operating current flows in the low power consumption state.

SUMMARY OF THE INVENTION

This invention offers a regulator circuit that includes a first control transistor, first and second resistors connected in series with the first control transistor, a first operational amplifier having a first differential input terminal to which a reference voltage is applied and a second differential input terminal to which a voltage at a connecting node between the first resistor and the second resistor is applied and applying its output to a gate of the first control transistor, a second control transistor connected in series with the first and second resistors, a second operational amplifier having a third differential input terminal to which the reference voltage is applied and a fourth differential input terminal to which the voltage at the connecting node between the first resistor and the second resistor is applied and applying its output to a gate of the second control transistor and a switching circuit that selects the first operational amplifier to operate in a first state (a first mode) and selects the second operational amplifier to operate in a second state (a second mode), wherein a current driving capability of the first operational amplifier is greater than a current driving capability of the second operational amplifier.

This invention also offers the regulator circuit wherein a ratio of a channel width to a channel length of an output transistor in the second operational amplifier is smaller than a ratio of a channel width to a channel length of an output transistor in the first operational amplifier.

This invention also offers the regulator circuit wherein a ratio of a channel width to a channel length of the second control transistor is smaller than a ratio of a channel width to a channel length of the first control transistor.

This invention also offers the regulator circuit wherein the switching circuit turns off the second control transistor in the first state by applying a predetermined voltage to the gate of the second control transistor and turns off the first control transistor in the second state by applying a predetermined voltage to the gate of the first control transistor.

DETAILED DESCRIPTION OF THE INVENTION

Figure 1:
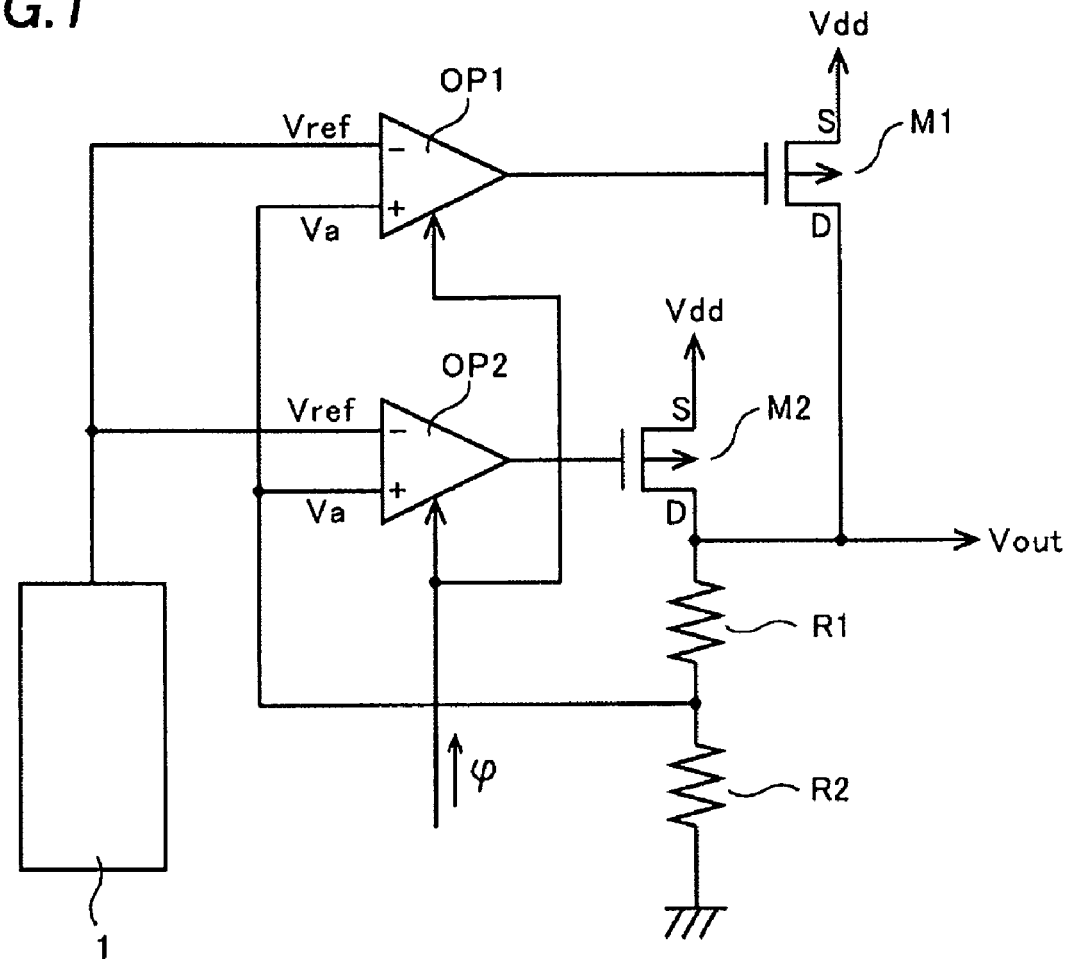
FIG. 1 is a circuit diagram showing a regulator circuit according to an embodiment of this invention.

A regulator circuit according to an embodiment of this invention will be explained hereafter referring to the drawings.

FIG. 1 shows an example of a circuit structure of the regulator circuit according to the embodiment of this invention. The regulator circuit is provided with a first control MOS transistor M1 of P-channel type having a source to which a power supply voltage Vdd is applied, a first resistor R1 and a second resistor R2 connected in series with a drain of the first control MOS transistor M1, and an operational amplifier OPI having a differential input terminal (−) to which a reference voltage Vref is applied and another differential input terminal (+) to which a voltage Va at a connecting node between the first resistor R1 and the second resistor R2 is applied and applying its output to a gate of the first control MOS transistor M1.

In this embodiment, the size of an output transistor in the first operational amplifier and the size of the first control MOS transistor M1 are large to obtain an operating current when a high current driving capability is required, that is, in a normal operation state in the case of a microcomputer.

The regulator circuit is also provided with a second control MOS transistor M2 of P-channel type having a drain that is connected in series with the first and second resistors R1 and R2 and a second operational amplifier OP2 having a differential input terminal (−) to which the reference voltage Vref is applied and another differential input terminal (+) to which the voltage Va at the connecting node between the first resistor R1 and the second resistor R2 is applied and applying its output to a gate of the second control MOS transistor M2.

In this embodiment, the size of an output transistor in the second operational amplifier and the size of the second control MOS transistor M2 are small to obtain an operating current when a high current driving capability is not required, that is, in a low power consumption state in the case of the microcomputer.

For example, the size of the output transistor in the second operational amplifier OP2 is about 1/10 of the size of the output transistor in the first operational amplifier OP1 and the size of the second control MOS transistor M2 is about 1/10 of the size of the first control MOS transistor M1. Here, the size denotes GW (channel width)/GL (channel length) of the transistor.

The reference voltage Vref is generated by a reference voltage generation circuit 1 and is supplied to the differential input terminal (−) of each of the operational amplifiers OP1 and OP2. And an output voltage Vout is outputted from a connecting node between the first and second control MOS transistors M1 and M2 and the first resistor R1.

Also, there is provided a switching circuit that selects one of the operational amplifiers OP1 and OP2 in response to a control signal ϕ. The switching circuit is disposed in each of the operational amplifiers OP1 and OP2 or in a peripheral circuit (not shown in FIG. 1) of each of the operational amplifiers OP1 and OP2.

A mode switch signal of the semiconductor integrated circuit may be used as the control signal ϕ. In this embodiment, a low level (L) of the control signal ϕ represents the normal operation state of the semiconductor integrated circuit and a high level (H) of the control signal ϕ represents the low power consumption state.

When the low level (L) of the control signal ϕ is applied, the first operational amplifier OP1 operates while the second operational amplifier OP2 does not operate. When the high level (H) of the control signal ϕ is applied, on the other hand, the first operational amplifier OP1 does not operate while the second operational amplifier OP2 operates.

In the regulator circuit according to the embodiment of this invention, as described above, there are provided at least two operational amplifiers having output transistors different in size from each other and at least two control MOS transistors different in size from each other, and the operational amplifier in operation can be switched by the control signal ϕ.

Next, an example of concrete circuit structure and its operation of each of the operational amplifiers OP1 and OP2 will be explained referring to FIGS. 2A and 2B.

Figure 2A:
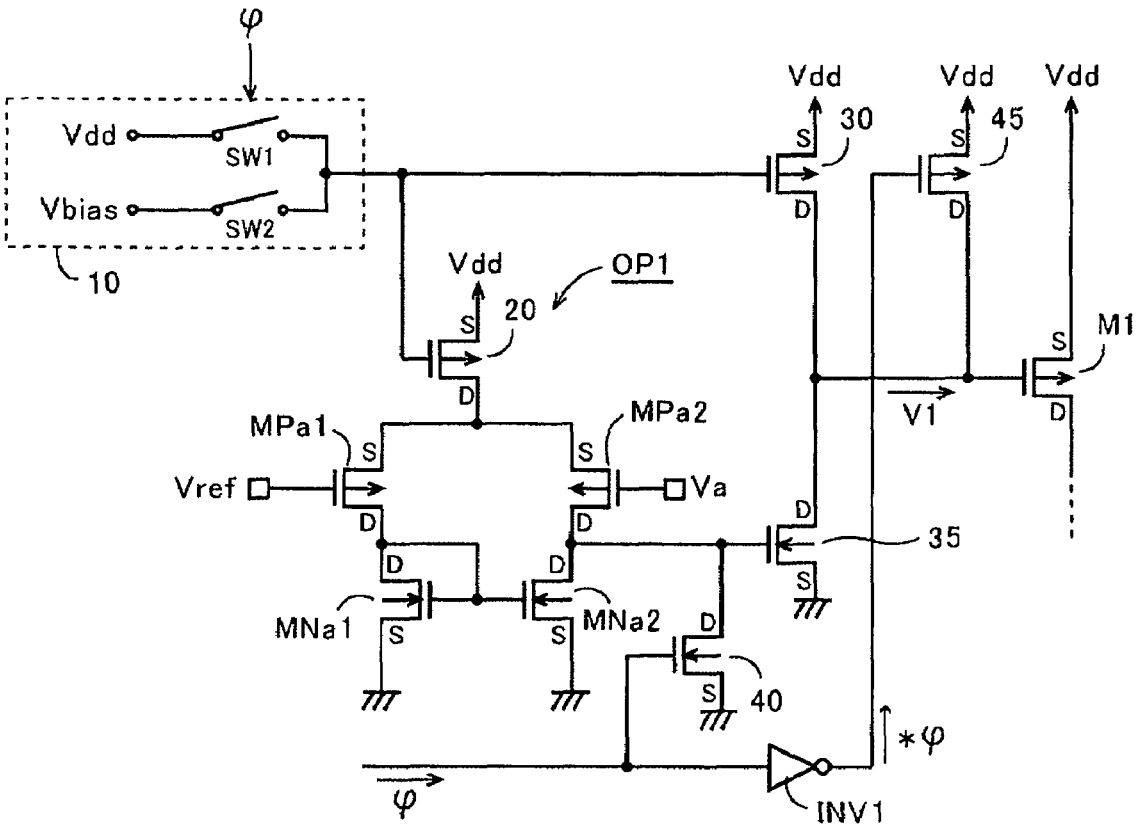
FIGS. 2A and 2B are circuit diagrams showing operational amplifiers in the regulator circuit according to the embodiment of this invention.

FIG. 2A shows the first operational amplifier OP1 and its peripheral circuits. The first operational amplifier OP1 is provided with a pair of N-channel type MOS transistors MNa1 and MNa2 connected to form a current mirror, a pair of P-channel type MOS transistors MPa1 having a gate to which the reference voltage Vref is applied and MPa2 having a gate to which the voltage Va is applied, and a P-channel type first constant current transistor 20 having a gate to which the power supply voltage Vdd or a bias voltage Vbias is applied and a source to which the power supply voltage Vdd is applied.

In an output stage of the first operational amplifier OP1, there are provided a P-channel type output transistor 30 having a source to which the power supply voltage Vdd is applied and a gate to which the power supply voltage Vdd or the bias voltage Vbias is applied, and an N-channel type output transistor 35 having a drain connected with a drain of the output transistor 30, a gate connected with a connecting node between the MOS transistor MPa2 and MNa2 and a source connected with the ground. A differential output voltage V1 is outputted from a connecting node between the output transistors 30 and 35, and is applied to the gate of the first control MOS transistor M1.

Also there are provided an N-channel type MOS transistor 40 having a drain connected with the connecting node between the MOS transistor MPa2 and MNa2, a gate to which the control signal ϕ is applied and a source connected to the ground, and a P-channel type MOS transistor 45 having a source to which the power supply voltage Vdd is applied, a gate to which an inverted control signal *ϕ generated by inverting the control signal ϕ with an inverter INV1 and a drain which is connected with the gate of the first control MOS transistor M1.

Also, there is provided a control circuit 10 that controls the voltage applied to the gate of the first constant current transistor 20 and the gate of the output transistor 30. In the control circuit 10, switches SW1 and SW2 are turned on and off according to the control signal ϕ.

Figure 2B:
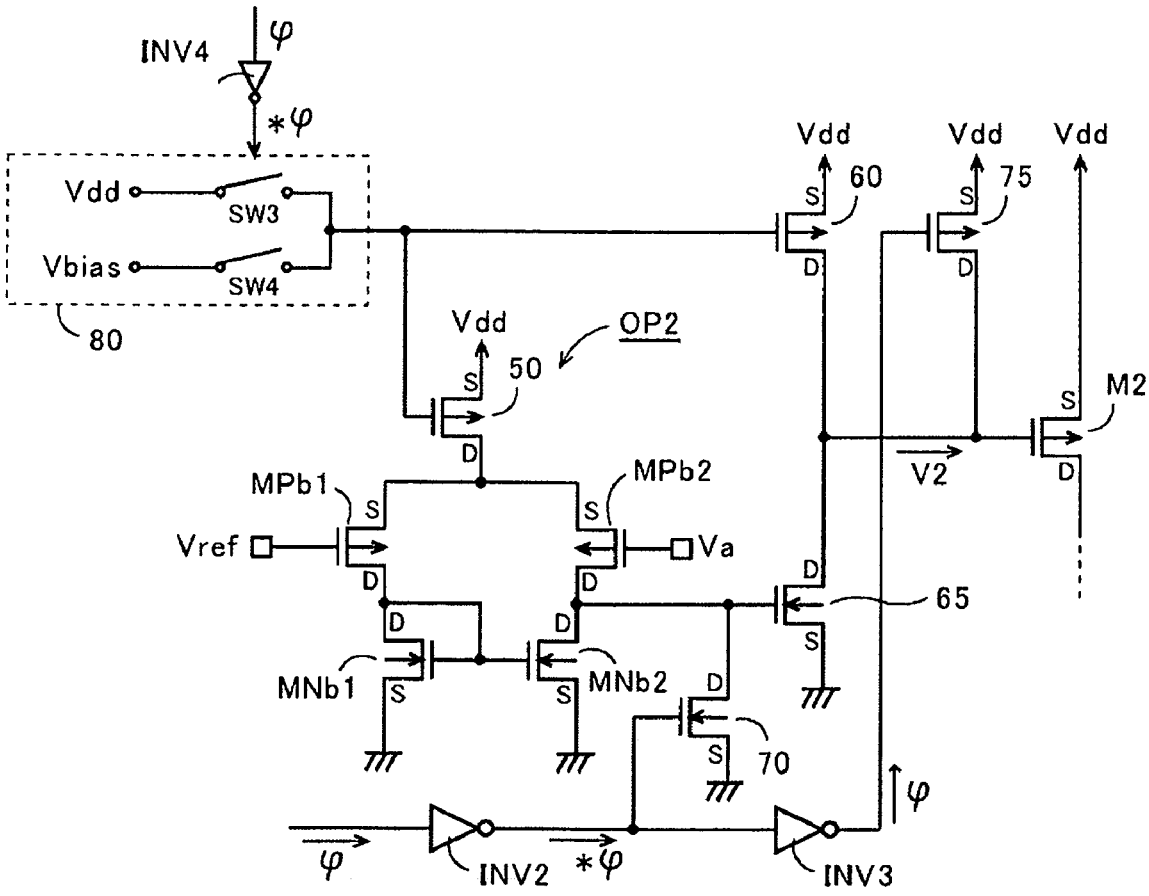
Figure 3:
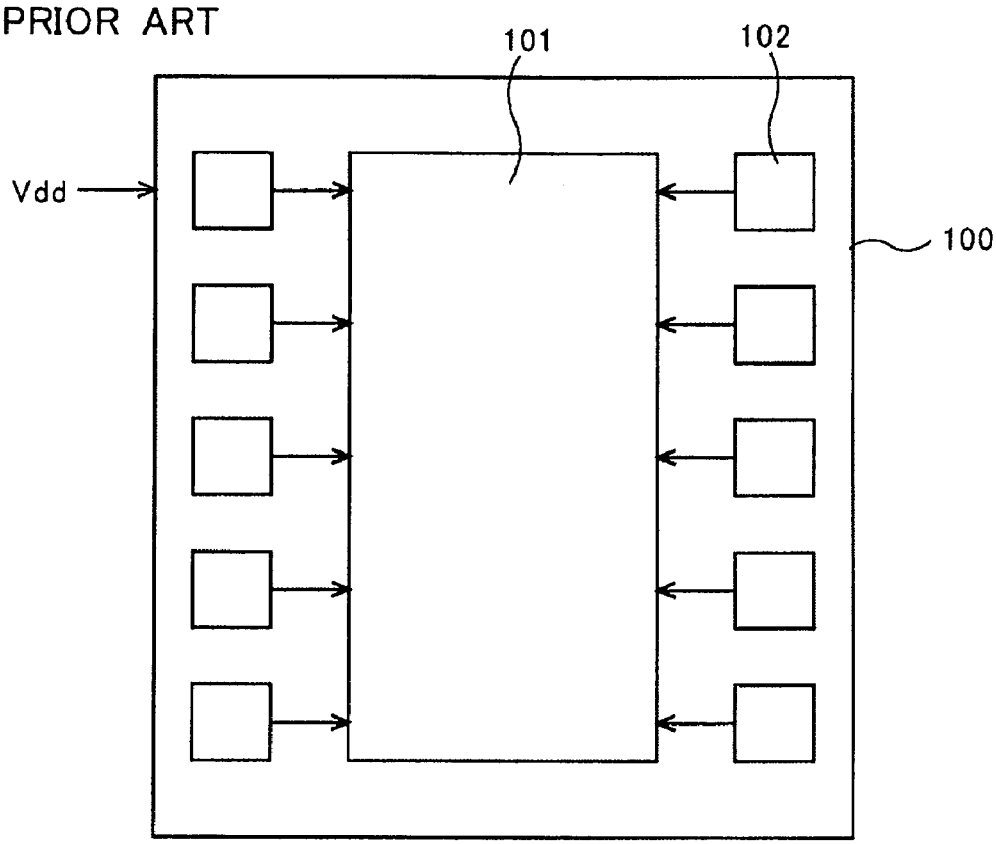
FIG.3 PRIOR ART
FIG. 3 is a layout showing a common semiconductor integrated circuit.
Figure 4:
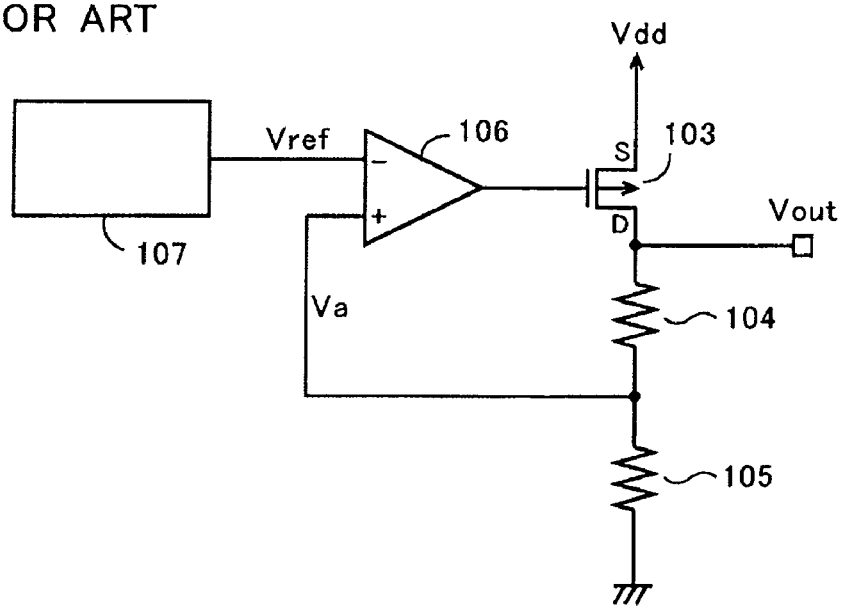
FIG.4 PRIOR ART
FIG. 4 is a circuit diagram showing a conventional regulator circuit.

FIG. 2B shows the second operational amplifier OP2 and its peripheral circuits. The second operational amplifier OP2 is provided with a pair of N-channel type MOS transistors MNb1 and MNb2 connected to form a current mirror, a pair of P-channel type MOS transistors MPb1 having a gate to which the reference voltage Vref is applied and MPb2 having a gate to which the voltage Va is applied, and a P-channel type second constant current transistor 50 having a gate to which the power supply voltage Vdd or the bias voltage Vbias is applied and a source to which the power supply voltage Vdd is applied.

In an output stage of the second operational amplifier OP2, there are provided a P-channel type output transistor 60 having a source to which the power supply voltage Vdd is applied and a gate to which the power supply voltage Vdd or the bias voltage Vbias is applied, and an N-channel type output transistor 65 having a drain connected with a drain of the output transistor 60, a gate connected with a connecting node between the MOS transistor MPb2 and MNb2 and a source connected with the ground. The size and the current driving capability of each of the output transistors 60 and 65 are smaller than the size and the current driving capability of corresponding each of the output transistors 30 and 35 in the first operational amplifier OP1. A differential output voltage V2 is outputted from a connecting node between the output transistors 60 and 65, and is applied to the gate of the second control MOS transistor M2.

Also there are provided an N-channel type MOS transistor 70 having a drain connected with the connecting node between the MOS transistor MPb2 and MNb2, a gate to which the inverted control signal *ϕ generated by inverting the control signal ϕ with an inverter INV2 is applied and a source connected to the ground, and a P-channel type MOS transistor 75 having a source to which the power supply voltage Vdd is applied, a gate to which the control signal ϕ is applied through the inverter INV2 and an inverter INV3 and a drain which is connected with the gate of the second control MOS transistor M2.

Also, there is provided a control circuit 80 that controls the voltage applied to the gate of the second constant current transistor 50 and the gate of the output transistor 60. In the control circuit 80, switches SW3 and SW4 are turned on and off according to the inverted control signal *ϕ that is generated by inverting the control signal ϕ with an inverter INV4.

The control circuits 10 and 80 and the MOS transistors 40, 45, 70 and 75 serve as a switching circuit that applies a voltage to the gate of the second control MOS transistor M2 to turn off the second control MOS transistor M2 as well as selecting the first operational amplifier OP1 to operate in the normal operation state and applies the voltage to the gate of the first control MOS transistor M1 to turn off the first control MOS transistor M1 as well as selecting the second operational amplifier OP1 to operate in the low power consumption state.

Next, an operation of the circuits described above will be explained. When the low level (L) of the control signal ϕ is applied to the control circuit 10 in the normal operation state, the switch SW1 is turned off and the switch SW2 is turned on to apply the bias voltage Vbias to the gates of the first constant current transistor 20 and the output transistor 30. At the same time, the high level (H) of the inverted control signal *ϕ is applied to the control circuit 80 to turn on the switch SW3 and turn off the switch SW4, thus the power supply voltage Vdd is applied to the gates of the second constant current transistor 50 and the output transistor 60.

As a result, the first constant current transistor 20 and the output transistor 30 are turned on, the first operational amplifier OP1 operates, and the differential output voltage V1 of a predetermined voltage is applied to the gate of the first control MOS transistor M1. Thus, the first control MOS transistor M1 is turned on and the regulator circuit outputs a predetermined output voltage Vout. On the other hand, the second constant current transistor 50 and the output transistor 60 are turned off and the second operational amplifier OP2 does not operate.

Since the MOS transistor 70 is turned off by the high level (H) of the inverted control signal *ϕ applied to its gate through the inverter INV2, the gate of the output transistor 65 is fixed to the low level (ground voltage) to turn off the output transistor 65.

Since the MOS transistor 75 is turned on by the low level (L) of the control signal ϕ applied through the inverters INV2 and INV3, the gate of the second control MOS transistor M2 is thereby fixed to the high level (power supply voltage Vdd) to turn off the second control MOS transistor M2.

On the other hand, when the high level (H) of the control signal ϕ is applied to the control circuit 10 in the low power consumption state, the switch SW1 is turned on and the switch SW2 is turned off to apply the power supply voltage Vdd to the gates of the first constant current transistor 20 and the output transistor 30. At the same time, the low level (L) of the inverted control signal *ϕ is applied to the control circuit 80 to turn off the switch SW3 and turn on the switch SW4, thus the bias voltage Vbias is applied to the gates of the second constant current transistor 50 and the output transistor 60.

As a result, the second constant current transistor 50 and the output transistor 60 are turned on, the second operational amplifier OP2 operates, and the differential output voltage V2 of a predetermined voltage is applied to the gate of the second control MOS transistor M2. Thus, the second control MOS transistor M2 is turned on and the regulator circuit outputs a predetermined output voltage Vout, providing a most suitable current for the low power consumption state. On the other hand, the first constant current transistor 20 and the output transistor 30 are turned off and the first operational amplifier OP1 does not operate.

Since the MOS transistor 40 is turned on by the high level (H) of the control signal ϕ applied to its gate, the gate of the output transistor 35 is fixed to the low level (ground voltage). As a result, the output transistor 35 is turned off.

Since the MOS transistor 45 is turned on by the low level (L) of the inverted control signal *ϕ applied to its gate through the inverter INV1, the gate of the first control MOS transistor M1 is thereby fixed to the high level (power supply voltage Vdd) to turn off the first control MOS transistor M1.

With the regulator circuit according to the embodiment of this invention, as described above, the current driving capability of the regulator circuit is switched based on the state which the semiconductor integrated circuit is in, i.e., the normal operation state or the low power consumption state. Therefore, the operating current most suitable for the current state can be provided, making it possible to suppress the current consumption.

What is claimed is:

1. A regulator circuit comprising:

a first transistor;

a first resistor and a second resistor connected in series with the first transistor;

a first operational amplifier comprising a first differential input terminal and a second differential input terminal, a reference voltage being applied to the first differential input terminal, a voltage at a node between the first and second resistors being applied to the second differential input terminal, and an output of the first operational amplifier being applied to a gate of the first transistor;

a second transistor connected in series with the first and second resistors;

a second operational amplifier comprising a third differential input terminal and a fourth differential input terminal, the reference voltage being applied to the third differential input terminal, the voltage at the node between the first and second resistors being applied to the fourth differential input terminal, and an output of the second operational amplifier being applied to a gate of the second transistor; and a switching circuit making the first operational amplifier to operate and the second operational amplifier not to operate in a first mode and making the first operational amplifier not to operate and the second operational amplifier to operate in a second mode, wherein a current driving capability of the second operational amplifier is smaller than a current driving capability of the first operational amplifier.

2. The regulator circuit of claim 1, wherein a ratio of a channel width to a channel length of an output transistor in the second operational amplifier is smaller than a ratio of a channel width to a channel length of an output transistor in the first operational amplifier.

3. The regulator circuit of claim 1, wherein a ratio of a channel width to a channel length of the second transistor is smaller than a ratio of a channel width to a channel length of the first transistor.

4. The regulator circuit of claim 1, wherein the switching circuit applies to the gate of the second transistor a voltage that turns off the second transistor in the first mode and applies to the gate of the first transistor a voltage that turns off the first transistor in the second mode.

5. The regulator circuit of claim 1, wherein the first mode is a normal operation mode of a microcomputer and the second mode is a low power consumption mode of the microcomputer.

* * * * *